US006014534A

United States Patent [19]

Goebel et al.

[11] Patent Number: 6,014,534

[45] Date of Patent: Jan. 11, 2000

[54] TONER CARTRIDGE APPARATUS AND SEALING METHOD

[75] Inventors: Thomas A. Goebel; Cole Barton, both of Austin, Tex.

[73] Assignee: TonerPlus, Inc., Austin, Tex.

[21] Appl. No.: 09/150,227

[22] Filed: Sep. 9, 1998

[51] Int. Cl.[7] ..... G03G 15/08

[52] U.S. Cl. ..... 399/106; 399/262

[58] Field of Search ..... 141/287; 156/94, 156/247, 344; 399/102, 103, 105, 106, 110, 111, 262; 347/85, 86; 222/542

[56] References Cited

U.S. PATENT DOCUMENTS 5,799,712 9/1998 Kelly et al. ..... 141/287

5,826,140 10/1998 Zona et al. ..... 399/106

*Primary Examiner*—Arthur T. Grimley

*Assistant Examiner*—Hoang Ngo

*Attorney, Agent, or Firm*—Russell D. Culbertson; Shaffer & Culbertson, LLP

[57] ABSTRACT

A toner cartridge (10) includes a bin component (11) and a cover component (12) adapted to be connected together in a connected position. The bin component (11) includes a toner bin (14) having a bin opening (15) and further includes a toner bin sealing surface (20) extending around the periphery of the bin opening (15). The cover component (12) includes a cover opening (26) and a cover sealing surface (30). When the bin component (11) and cover component (12) are in the connected position the toner bin sealing surface (20) is aligned with the cover sealing surface (30) so that the surfaces defining a seal receiving pocket. The seal receiving pocket is adapted to receive a toner bin seal (60) which includes a base sheet (61) comprised of a resilient material having a thickness greater than the clearance between the toner bin sealing surface (20) and cover sealing surface (30). The toner bin seal (60) includes a removable sealing film (68) which may be removed to expose the toner contained in the toner bin (14).

12 Claims, 4 Drawing Sheets

TONER CARTRIDGE APPARATUS AND SEALING METHOD

TECHNICAL FIELD OF THE INVENTION

This invention relates to xerographic devices, and more particularly to a reusable or rechargeable xerographic toner cartridge assembly used in xerographic devices. The invention also encompasses both a seal for sealing a toner bin within a toner cartridge, and a toner bin sealing method.

BACKGROUND OF THE INVENTION

Xerography is a printing process in which very fine powder referred to as "toner" is applied to paper or other material to form an image. Photocopiers, printers, plotters, and facsimile machines are examples of devices which may utilize a xerographic printing process. All xerographic devices require a supply of toner for use in the xerographic process. Since the toner supply in a xerographic device is used up in the printing process, the toner supply must be the replenished periodically.

Toner is commonly supplied in toner cartridge assemblies which include a toner bin or hopper. The toner cartridge assembly may also include other components of the xerographic device. For example, toner cartridges commonly include a magnetic roller assembly used in the xerographic process. Regardless of the other components which may be included in a toner cartridge, the toner bin within the cartridge assembly is sealed in order to prevent the fine toner powder from leaking while the cartridge is stored or transported. Prior to loading the toner cartridge into a xerographic device, the toner bin seal must be removed in order to make the toner available for use by the xerographic device.

Toner cartridges which are originally supplied with xerographic devices are commonly intended to be disposable after a single use. However, since the cartridges include a large number of relatively complex components, using these cartridge assemblies only a single time is expensive and wasteful. For this reason a toner cartridge recycling industry has developed to refurbish and recycle used toner cartridge assemblies. Recycling a used toner cartridge involves at least refilling the depleted toner bin with toner and resealing the toner bin for storage and shipment.

Numerous problems arise with recycling toner cartridge assemblies. Most toner cartridge assemblies are purposefully designed so that the toner bin is not readily accessible. Thus the recycler must pry or cut open the cartridge assembly to gain access to the toner bin. Specialized toner cartridge splitting equipment has been developed for cutting used cartridges open to expose the toner bin. This specialized equipment is at the very least expensive and sometimes can damage a used toner cartridge beyond repair. Once the various components of the toner cartridge assembly are pried or cut apart, the components are not easily put back together in a secure fashion. The problem of reassembling the toner cartridge components is exacerbated by the very limited space available for reconnecting arrangements. Furthermore, the toner material itself is very fine and difficult to seal securely, particularly with a seal which must be easily removable.

SUMMARY OF THE INVENTION

It is a broad object of the invention to provide a recyclable toner cartridge assembly and toner bin seal and sealing method which overcome the above described problems and others associated with prior toner cartridge assemblies and toner seals.

A reusable or recyclable toner cartridge assembly according to the invention includes a toner bin component and a cover component. The toner bin component includes a toner bin or hopper with a toner bin opening through which toner is supplied for a xerographic process. The toner bin component also includes a bin component flange and toner bin sealing surface extending around the periphery of the bin opening. The cover component may form part of a magnetic roller assembly and includes a cover opening adapted to register generally with the toner bin opening. The cover component also includes a cover flange and a cover sealing surface extending around the periphery of the cover opening. The toner cartridge assembly also includes a connecting arrangement for securely connecting the bin component and cover component preferably by their associated flanges.

When the bin component and cover component are in a connected position, the cover opening generally registers or aligns with the toner bin opening of the bin component and the flanges of the two components generally abut each other. In this connected position the cover sealing surface and the toner bin sealing surface are also generally aligned with each other and define a pocket with a predetermined spacing between the two sealing services. This pocket is adapted to receive a seal for sealing the toner bin opening for storage and shipping, and for providing a seal between the two components. The pocket between the toner bin sealing surface and cover sealing surface ensures a proper crush or pressure on the seal material and helps provide and maintain a secure seal.

Either the toner bin sealing surface or the cover sealing surface, or both, may include an additional crush structure which provides less clearance than the predetermined clearance between the two sealing surfaces. This added crush structure enhances the crush on the seal material in a localized area around the periphery of the seal, and enhances the seal. The preferred crush structure includes a ridge which protrudes from the respective sealing surface into the area defining pocket. Ridges extending from both sealing surfaces may be adapted to register or interlock to provide an enhanced localized crush in locations around the periphery of the toner bin seal.

The bin component and cover component connecting arrangement may include any suitable arrangement for securely connecting the components together. The preferred connecting arrangement operates on the flanges associated with the components. One preferred form of the invention includes clips which fit over the abutting flanges and clip the flanges together. Each clip may include projections which cooperate with indentations formed on the flanges to provide a more secure connection. A releasing arrangement may also be built into each clip and the flanges for helping to remove the clips for subsequent toner bin refilling operations.

The toner bin seal according to invention includes a base sheet adapted to fit in the pocket between the toner bin sealing surface and cover sealing surface. The base material includes a toner access opening formed therein and a sealing film is secured over the toner access opening. The sealing film is attached to the base sheet in a film attachment area around the periphery of the toner access opening. A sealing area is also included on the base sheet around the periphery of the film attachment area. Finally, a pull element is connected to one end of the sealing film and is long enough to be folded over the film and extend past the opposite end of the sealing film and base sheet.

The seal according to the invention is placed on the sealing surface of either the bin component or cover component. The two components are then connected together in the connected position and the predetermined clearance associated with the pocket allows the opposing sealing surfaces to crush or compress the base material in the sealing area of the base sheet. The base sheet may include an adhesive on one side for initially securing the seal to the desired sealing surface. Once the bin component and cover component are connected in the connected position, the base sheet and sealing film attached thereto combined to provide a secure seal over the toner bin. The sealing film may be removed by the pull element, leaving the toner in the toner bin exposed through the toner access opening formed in the base sheet. However, the base sheet remains in position to maintain the seal between the bin component and cover component of the toner cartridge assembly.

The toner cartridge assembly according to the invention provides many advantages over prior toner cartridges. The assembly does not have to be cut or broken apart to gain access for refilling the toner bin associated with the assembly. Also, the sealing arrangement provides a secure seal over the toner bin for storage and shipping, and yet provides a sealing film which is easily removable prior to installing the toner cartridge assembly into a xerographic device. Furthermore, the base sheet of the seal remains in place to maintain the desired seal between the bin and cover components even after the sealing film is removed.

These and other objects, advantages, and features of the invention will be apparent from the following description of the preferred embodiments, considered along with the accompanying drawings.

DESCRIPTION OF THE PREFERRED EMBODIMENTS

Figure 1:
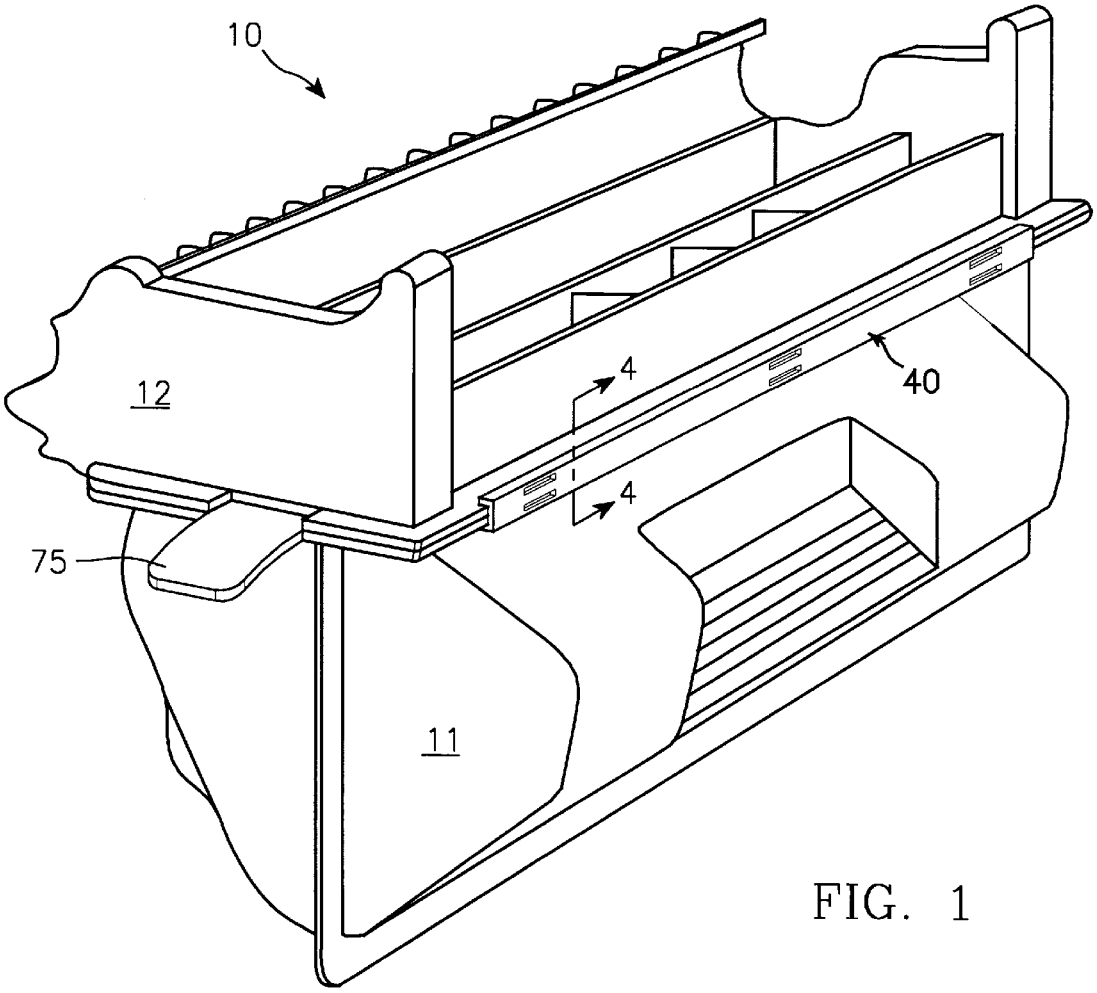
FIG. 1 is an isometric view of a toner cartridge assembly embodying the principles of the invention.

FIG. 1 shows one preferred form of a toner cartridge 10 embodying the principles of the invention. Toner cartridge 10 includes a bin component 11 shown alone in FIG. 2 and a cover component 12 shown alone in FIG. 3. In FIG. 3 cover component 12 is inverted from the position in which it is shown in FIG. 1. Toner cartridge 10 is adapted to be installed in a xerographic device such has a printer or photocopier. Those skilled in the art will appreciate that the invention is not limited to any particular type of xerographic device but is applicable to any device which utilizes a toner cartridge. Of course the shape of the toner cartridge must be changed to suit the particular device in which it is to be used. These changes in shape depending upon the particular xerographic device in which the cartridge is to be used are all within the scope of the invention and the following claims.

Figure 2:
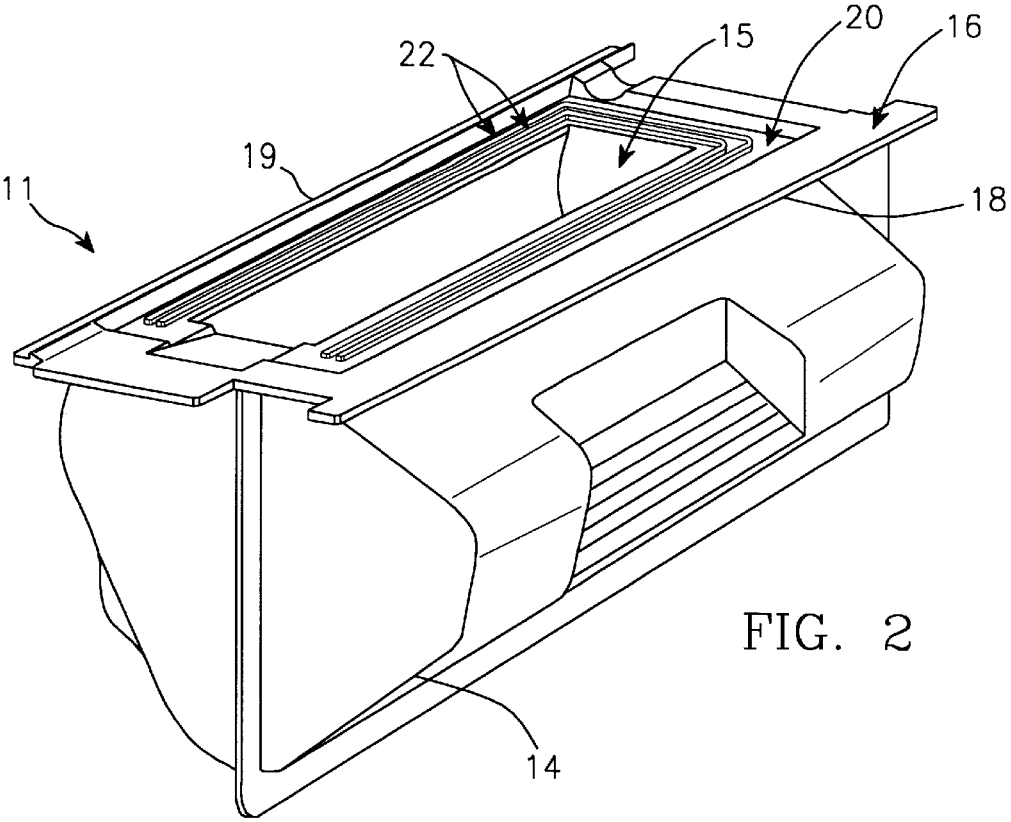
FIG. 2 is an isometric view of the bin component shown in FIG. 1.
Figure 3:
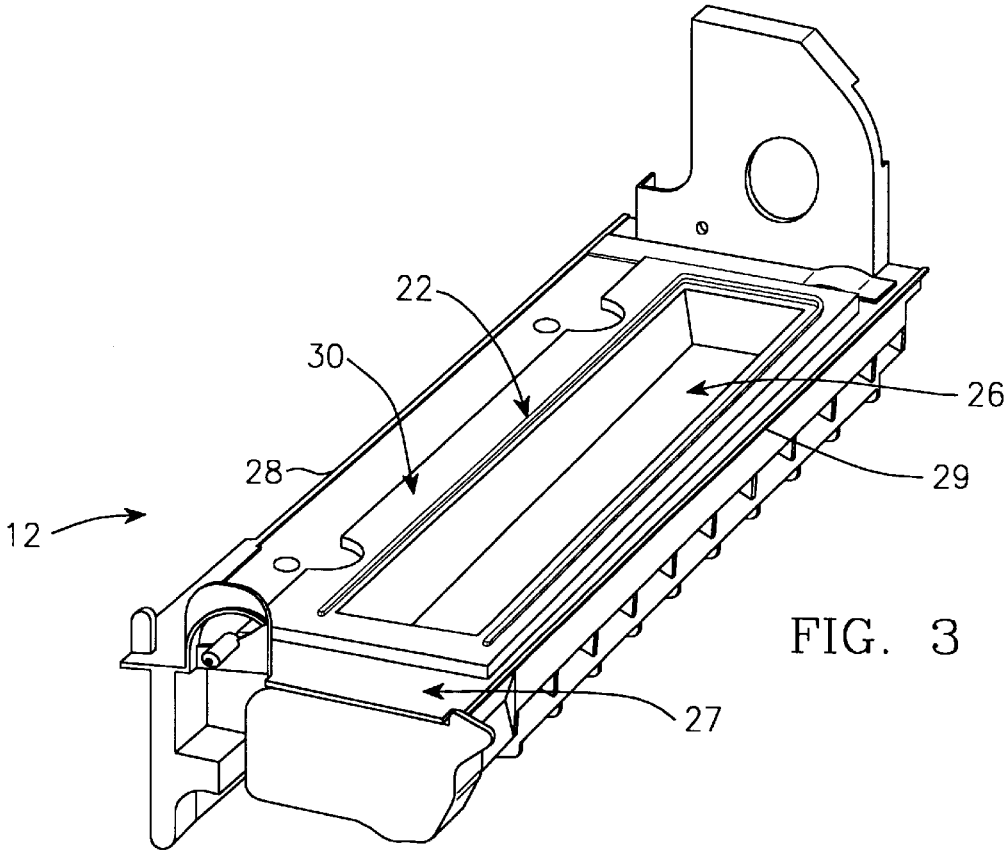
FIG. 3 is an isometric view of the cover component shown in FIG. 1.

Referring to FIG. 2, bin component 11 includes a toner bin or hopper 14. A toner bin opening 15 is formed over the bin 14. This opening 15 provides access for refilling the toner bin and also provides a passageway through which toner is supplied to the particular xerographic device in which the cartridge 10 is installed. Bin component 11 also includes a flange 16 having first and second lateral edges, 18 and 19 respectively, which extend parallel to the longitudinal axis of bin component 11. Bin component 11 also includes a toner bin sealing surface 20. Toner bin sealing surface 20 extends around the entire periphery of toner bin opening 15. The illustrated toner bin sealing surface 20 also includes a crush structure shown generally at reference number 22. This crush structure will be discussed below in detail with reference to FIG. 5.

Bin component 11 may be formed from any suitable material, and is preferably molded from a plastic material. The bin component 11 may be formed from several individual pieces which are connected together by some means. However, details regarding the manner in which the toner bin component 11 is formed are not necessary for an understanding of this invention and thus such details are omitted from this disclosure.

Figure 5:
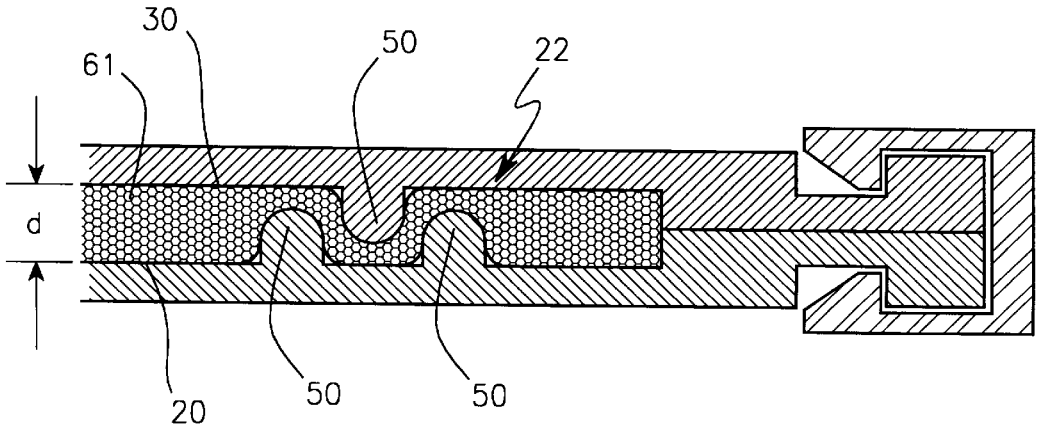
FIG. 5 is a partial section view showing a preferred crush structure between the toner bin sealing surface and cover sealing surface.

Referring now to FIG. 3, cover component 12 includes a cover opening 26 and a cover flange 27. Cover flange 27 includes first and second lateral edges, 28 and 29 respectively, which each extend parallel to the longitudinal axis of cover component 12. Cover component 12 also includes a cover sealing surface 30 which extends around the entire periphery of the cover opening 26. Another crush structure, shown generally at reference number 22 and discussed below in reference to FIG. 5, is preferably associated with cover sealing surface 30. Other components of the xerographic device may also be incorporated in cover component 12. For example, cover component 12 may include portions of a magnetic roller assembly or other components of a xerographic device. However, elements other than the cover opening 26, flange 27, cover sealing surface 30, and crush structure 22 are not material to this invention.

Bin component 11 and cover component 12 are adapted to be connected in a connected position shown in FIG. 1. The two components 11 and 12 may be connected by any suitable arrangement, including the clip arrangement which is described below in reference to FIG. 4. Regardless of the particular connecting arrangement employed, cover flange 27 and bin flange 16 tightly abut each other when the components 11 and 12 are in the connected position. Also, toner bin opening 15 and cover opening 26 are generally aligned, as are cover sealing surface 30 and toner bin sealing surface 20, when the two components 11 and 12 are in the connected position. The aligned sealing surfaces 20 and 30 define a pocket having a predefined clearance or spacing. This spacing is shown at element "d" in FIG. 5 and is described further below. The clearance or spacing between toner bin sealing surface 20 and cover sealing surface 30 may be formed by recessing one or both of the sealing surfaces with respect to its respective flange 16 and 27. In FIGS. 2 and 3, toner bin sealing surface 20 and cover sealing surface 30 are both shown as relatively wide planar surfaces. However, the sealing surfaces may comprise or be defined by one or more narrow ridge tops dictated by molding requirements.

Figure 4:
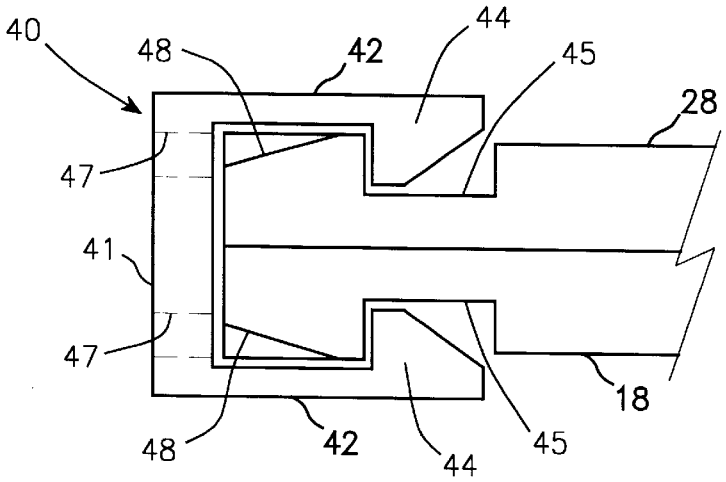
FIG. 4 is a partial section view through line 4—4 in FIG. 1.

Referring to FIGS. 1 and 4, the preferred connecting arrangement includes two clips 40, each clip adapted to connect along one of lateral flange edges for each component 11 and 12. As shown in FIG. 4, each clip 40 includes a clip base 41 and a pair of opposing clip arms 42. A retaining projection 44 extends from each clip arm 42 toward the opposite arm. Also, the preferred flange edges 18 and 28 include retaining indentations 45 adapted to receive the retaining projections 44. The retaining projections 44 and flange indentations 45 cooperate to securely hold the bin component 11 and cover component 12 tightly together in the connected position shown in FIG. 1. The illustrated connecting arrangement also includes release openings 47 in the clip base 41 along with beveled edges 48 on the opposing flange edges 18 and 28. A tool may be inserted into both release openings 47 to spread the clip arms 42 when it is desired to remove the clip 40.

A toner cartridge assembly embodying the principles of invention may include any suitable connecting arrangement for connecting the bin and cover components, 11 and 12 respectively. Alternatively to the illustrated clip connection, fasteners such as screws, bolts, or VELCRO fasteners could be used. These fasteners could be separate from the components or integrated into the components. In any event, those skilled in the art will appreciate that the invention is not limited to the clip-type connecting arrangement illustrated in FIGS. 1 and 4. Adhesives, glues, chemical welding, or sonic welding could also be used to join the bin and cover components according to the invention, although connecting the components in this fashion may prevent the cartridge from being reused easily.

FIG. 5 shows a portion of the pocket defined between toner bin sealing surface 20 and cover sealing surface 30 when bin component 11 and cover component 12 are in the connected position shown in FIG. 1. FIG. 5 also shows portions of a base sheet 61 which comprises portions of a seal according to the invention. Details of the base sheet 61 and the remainder of the toner bin seal will be described in detail below with reference to FIGS. 6 and 7. As shown in FIG. 5, toner bin sealing surface 20 and cover sealing surface 30 are separated a predefined clearance or space "d" when the components 11 and 12 are in the connected position. Clearance "d" is less than the thickness of base sheet 61 so that toner bin surface 20 and cover sealing surface 30 crush or compress the base sheet material. This crushing or compression helps form a secure seal around toner bin opening 15 and between bin component 11 and cover component 12. For example, the base sheet may be on the order of 0.0625 inches thick while the clearance "d" may be on the order of 0.020 inches. In any event, the clearance "d" is preferably approximately 25% or more less than the uncompressed thickness of the base sheet 61. Also, the clearance "d" may be greater along one side of the opposing sealing surfaces to provide less resistance for removing a sealing film described below with reference to FIGS. 6 and 7.

FIG. 5 also illustrates one preferred crush structure 22 which may be associated with one or both sealing surfaces 20 and 30. The crush structure 22 includes one or more ridges 50 extending from one or both of the sealing surfaces 20 and 30. In the illustrated form of the invention, a single ridge 50 extends from cover sealing surface 30 while two spaced apart ridges 50 extend from toner bin sealing surface 20. The ridge 50 extending from cover sealing surface 30 is adapted to fit in between the two ridges 50 extending from toner bin sealing surface 20, forcing the base sheet 61 to form generally an "S" shape around the ridges. The additional crush structure is preferably located at least along both lateral or long sides of the of the sealing surfaces 20 and 30. Also, the additional crush structure may be included on the ends or short sides of the sealing surfaces, however, it is important that the additional crush structure not interfere substantially with removing the sealing film as described below. Thus, the additional crush structure may be omitted from the areas of the sealing surfaces through which the sealing film is to be removed. For example, FIGS. 2 and 3 show that the additional crush structure 22 is omitted from areas "R" on one short side of the respective sealing surface 20 and 30.

Although the illustrated form of invention includes ridges 50 extending from both sealing surfaces 20 and 30, other forms of invention may include ridges extending only from a single one of the sealing surfaces. Regardless of the number of ridges 50, each ridge leaves a clearance with the opposing sealing surface which is less than the clearance "d" between the two sealing surfaces 20 and 30. Thus the crush structure crushes or compresses the base sheet 61 further and thereby enhances the seal around toner bin opening 15 and between bin component 11 and cover component 12. The ridges 50 also represent additional barriers to the migration of toner between the bin and cover component sealing surfaces 20 and 30. Although the illustrated ridges 50 include rounded tops, the ridges may be V-shaped or have some other shape.

Figure 6:
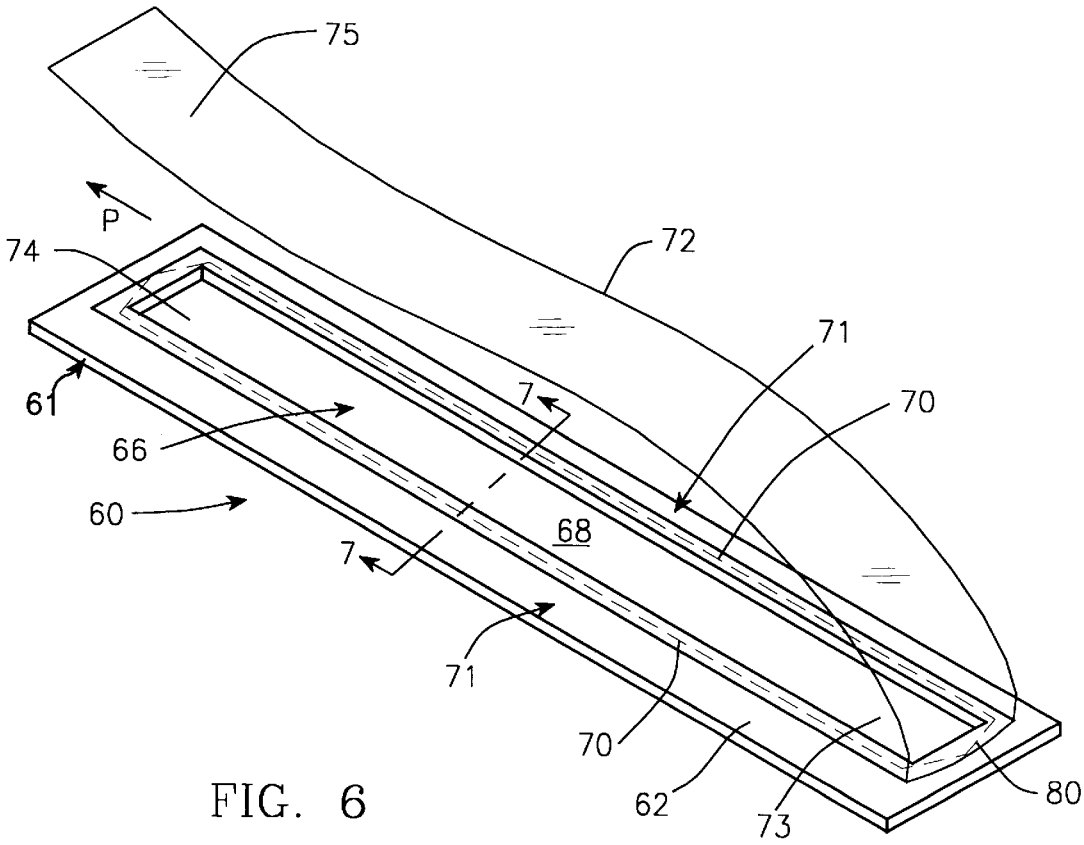
FIG. 6 is an isometric view of a toner bin seal embodying the principles of the invention.
Figure 7:
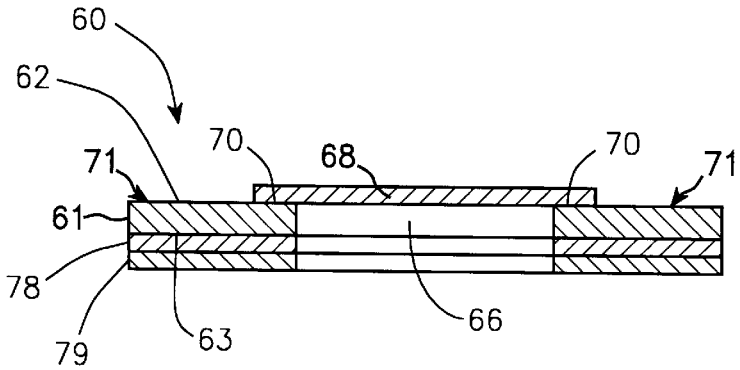
FIG. 7 is a view in section taken long line 7—7 and FIG. 6 and exaggerated in scale to show the various thin sheets of material included in the seal.

FIGS. 6 and 7 illustrate a toner bin seal 60 embodying the principles of invention. Seal 60 includes a base sheet 61 having an upper surface 62, a lower surface 63, and a toner access opening 66. A sealing film 68 completely covers toner access opening 66 and is connected to the base sheet 61 in a film attachment area 70 immediately adjacent to the toner access opening on upper surface 62. Base sheet 61 also includes a sealing area 71 extending around the periphery of the film 68 positioned on upper surface 62. Finally, the preferred seal 60 includes a pull element 72 which is connected to a first end 73 of sealing film 68. Pull element 72 is long enough to be folded back over the length of sealing film 68 and extend past a second end 74 of the sealing film opposite to the first end 73 and beyond the end of base sheet 61.

Referring particularly to FIG. 7, lower surface 63 of base sheet 61 may include a layer of adhesive 78 protected with a protective cover or sheet 79. The adhesive is adapted to remain adhered to lower surface 63 of base sheet 61 as protective sheet 79 is peeled back. Once protective sheet 79 is removed, the adhesive 78 helps hold the seal 60 in an initial position for forming the desired seal between bin component 11 and cover component 12 shown in FIG. 1.

Sealing film 68 may be sealed to base sheet 61 by any suitable means. For example, film 68 may be heat or chemical welded to base sheet 61, or connected with a suitable adhesive or glue. The connection or seal between base sheet 61 and sealing film 68 must be secure to prevent toner from leaking during shipping or storage, but must also allow the sealing film to be removed to expose toner access to opening 66 before the cartridge 10 (FIG. 1) is installed in a xerographic device. When the seal 60 is installed between bin component 11 and cover component 12 as will be discussed below, pull element 72 is used to peel the sealing film back by its first end 73 by pulling the pull element generally in the direction "P" shown in FIG. 6. To help sealing film 68 release from base sheet 61, the first end 73 of the sealing film preferably includes an angled attachment 80 to the base sheet. Angled attachment 80 narrows to a point which directs away from toner access opening 66 formed in base sheet 61. This angled attachment 80 reduces the area of the attachment at first end 73 which must be separated at a given time and thus reduces the force required for removing sealing film 68.

A wide variety of materials may be used for the various components of the toner bin seal 60 according to the invention. Base sheet 61 preferably comprises a resilient material and preferably a resilient closed cell foam, such as a cross link polyethylene, for example, having a smooth impermeable skin layer at the upper and lower surfaces. Sealing film 68 may comprise any thin, impermeable sheet material which is attachable to base sheet 61 and strong enough to be removed without breaking. For example, a puncture and tear resistant polyester film may be used as the sealing film 68. Alternatively to the peel-off sealing film 68 shown FIGS. 6 and 7, a tearable material may be used. This alternative tear-off type sealing film includes a central portion which is adapted to the tear away from portions connected to the base sheet as the pull element is pulled with sufficient force. The portions of the tear-off type sealing film connected to the base sheet would remain connected at the periphery of the toner access opening. This tear-off type of sealing film is to be considered an equivalent of the illustrated peel-off film.

The process of forming a seal according to the invention may be described with reference to FIGS. 1 through 3 and FIGS. 6 and 7. To form the desired seal in cartridge 10 shown in FIG. 1, seal 60 (FIGS. 6 and 7) is placed over the sealing surface associated with either cover component 11 or bin component 12. When adhesive 78 is used on lower surface 63 of base sheet 61, protective sheet 79 is first peeled off to expose the adhesive and then the adhesive may be pressed against the desired sealing surface. Whether an adhesive is used or not, once base sheet 61 is in position over the desired sealing surface 20 or 30 (FIGS. 2 and 3) pull element 72 is folded back over the length of sealing film 68 so that the distal end 75 of the pull element extends past second end 74 of the sealing film and drapes over the end of the particular component 11 or 12.

With the seal 60 in position on one of the sealing surfaces, either 20 or 30, bin component 11 and cover component 12 are connected together in the connected position shown in FIG. 1. As components 11 and 12 move into the connected position, the sealing surfaces 20 and 30 and any additional crush structure 22 associated with the sealing surfaces, serve to crush the base sheet 61 in the sealing area 71 around the entire periphery of the toner bin opening 15. This crush or compression helps press any adhesive layer 78 against the adjacent sealing 20 or 30. Even without an adhesive layer, the crush and pressure on the base sheet material around its sealing area 71 forms a secure seal around toner bin opening 15. Thus toner bin seal 60 cooperates with sealing surfaces 20 and 30 to seal toner bin opening 15 and also seal between bin component 11 and cover component 12. Distal end 75 of pull element 72 extends out one end of the connected cartridge assembly 10. To expose the toner contained in toner bin 15 prior to installing the cartridge assembly 10 in a xerographic device, the user simply pulls the distal end 75 of pull element 72 outwardly (direction "P" in FIG. 6) from the cartridge assembly. This pulling force peels sealing film 68 off base sheet 61 leaving toner access opening 66 exposed. Although the sealing film 68 is removed at this point, base sheet 61 remains in place to provide a secure seal between bin component 11 and cover component 12.

The above described preferred embodiments are intended to illustrate the principles of the invention, but not to limit the scope of the invention. Various other embodiments and modifications to these preferred embodiments may be made by those skilled in the art without departing from the scope of the following claims.

We claim:

1. A toner cartridge assembly for xerographic devices, the assembly comprising:

(a) a toner bin component having a toner bin for containing a supply of toner material, a toner bin opening through which toner is supplied for a xerographic process, a toner bin flange associated with the toner bin opening, and a toner bin sealing surface extending around the periphery of the toner bin opening;

(b) a cover component having a cover opening, a cover flange, and a cover sealing surface extending around the periphery of the cover opening;

(c) a connecting arrangement for connecting the toner bin component and the cover component together in a connected position in which the cover opening and toner bin opening are generally aligned, the cover sealing surface and the toner bin sealing surface are generally aligned, and the toner bin flange and cover flange are generally aligned in an abutting relationship; and (d) a seal receiving pocket defined between the cover sealing surface and toner bin sealing surface when the toner bin component and cover component are in the connected position with the toner bin flange and cover flange in the abutting relationship, the seal receiving pocket having a first predefined clearance between the cover sealing surface and toner bin sealing surface.

2. The toner cartridge assembly of claim 1 further comprising:

(a) a crush structure between the cover sealing surface and toner bin sealing surface, the crush structure extending around at least portions the periphery of the toner bin opening when the toner bin component and cover component are in the connected position.

3. The toner cartridge assembly of claim 2 wherein the crush structure includes:

(a) a crush ridge projecting from the cover sealing surface such that the clearance between the crush ridge and the toner bin sealing surface when the toner bin component and cover component are in the connected position is smaller than the first clearance.

4. The toner cartridge assembly of claim 3 wherein the crush structure further comprises:

(a) spaced apart outer ridges projecting from the toner bin sealing surface, the crush ridge extending and between the outer ridges when the cover component and toner bin component are in the connected position.

5. The toner cartridge assembly of claim 2 wherein the crush structure includes:

(a) a crush ridge projecting from the toner bin sealing surface such that the clearance between the crush ridge and the cover sealing surface when the toner bin component and cover component are in the connected position is smaller than the first clearance.

6. The toner cartridge assembly of claim 1 wherein the toner bin component and cover component are connected together in the connected position by the toner bin flange and the cover flange at first and second flange edges and wherein the connecting arrangement includes:

(a) at least one clip adapted to be positioned on each of the first and second flange edges for clipping the toner bin flange and cover flange together.

7. The toner cartridge assembly of claim 6 wherein:

(a) each clip comprises a clip base with a pair of opposing clip arms extending therefrom and biased toward each other, each clip arm having a retaining projection extending toward the opposing clip arm; and (b) the toner bin flange and the cover flange each include a retainer indentation for receiving the retaining projection.

8. The toner bin assembly of claim 7 wherein: p1 (a) the first flange edge and second flange edge each have an outwardly beveled surface; and (b) each clip includes at least one opening in the clip base for inserting a removal tool between the beveled surface and the adjacent clip arm.

9. The toner cartridge assembly of claim 6 wherein a single clip is adapted to extend along the first flange edge and a single clip is adapted to extend along the second flange edge.

10. A method of sealing xerographic toner in a toner cartridge assembly having a toner bin component and a cover component, the method comprising the steps of:

(a) positioning a toner bin seal on a toner bin sealing surface extending around the entire periphery of a toner bin opening associated with the toner bin component, the toner bin seal comprising (i) a base comprising a sheet of resilient material having a sealing area extending around a periphery thereof and a toner access opening located in a central area thereof;

(ii) a sealing film covering the toner access opening, the sealing film being sealed to an upper surface of the base; and (iii) a pull element connected to a first end of the sealing film;

(b) folding the pull element back over the length of the sealing film so that a distal end of the pull element extends over an edge of the toner bin component;

(c) connecting the toner bin component and a cover component together in a connected position in which a flange on the toner bin component and a flange on the cover component abut each other with substantially no clearance and in which a cover sealing surface formed on the cover component is aligned with the toner bin sealing surface and toner bin seal positioned thereon, the cover sealing surface and the toner bin sealing surface defining a pocket having a predefined clearance; and (d) substantially compressing at least a portion of the seal base material around the entire periphery of the toner bin opening as the toner bin component and cover component are connected together.

11. The toner cartridge sealing method of claim 10 wherein the step of positioning the toner bin seal on the toner bin sealing surface includes:

(a) adhering the toner bin seal to the toner bin sealing surface with an adhesive layer positioned on the toner bin seal.

12. The toner cartridge sealing method of claim 11 further comprising the step of:

(a) crushing the toner bin seal in the sealing area with a crush structure as the toner bin component and cover component are connected together in the connected position, the crush structure being located between the toner bin sealing surface and the cover sealing surface.

* * * * *

UNITED STATES PATENT AND TRADEMARK OFFICE

CERTIFICATE OF CORRECTION

PATENT NO. : 6,014,534

DATED : January 11, 2000

INVENTOR(S) : Thomas A. Goebel, et al

It is certified that error appears in the above-identified patent and that said Letters Patent is hereby corrected as shown below:

In Claim 8, column 9, line 6 of the Patent, delete "pl (a) the".

In Claim 8, column 9, line 7 of the Patent, insert: --(a) the-- before "first flange edge."

Signed and Sealed this

Twenty-fourth Day of October, 2000

*Attest:*

Q. TODD DICKINSON

*Attesting Officer*

*Director of Patents and Trademarks*